United States Patent [19]

Harkness

[11] 4,379,541

[45] Apr. 12, 1983

[54] HOLDER FOR A CONTAINER

[76] Inventor: Donald M. Harkness, 294 Main North Rd., Christchurch, New Zealand

[21] Appl. No.: 162,435

[22] Filed: Jun. 24, 1980

[30] Foreign Application Priority Data

Jul. 23, 1979 [NZ] New Zealand ..... 191083

[51] Int. Cl.[3] ..... A47K 1/08

[52] U.S. Cl. ..... 248/544; 248/313

[58] Field of Search ..... 248/311.2, 313, 314, 248/315, 544

[56] References Cited

U.S. PATENT DOCUMENTS

| | | | |
|---|---|---|---|
| 1,430,525 | 9/1922 | Webber | 248/313 X |
| 2,448,456 | 8/1948 | Niskanen et al. | 248/544 X |
| 2,662,719 | 12/1953 | Hammond | 248/314 |
| 2,845,245 | 7/1958 | Gray et al. | 248/314 |
| 2,877,976 | 3/1959 | Massari | 248/313 |
| 2,903,225 | 9/1959 | Weinstein | 248/311.2 |
| 3,177,048 | 4/1965 | Whatley | 248/314 X |
| 3,193,232 | 7/1965 | Hatcher | 248/311.2 X |
| 3,224,720 | 12/1965 | Hain | 248/313 |
| 3,680,820 | 8/1972 | Gracie | 248/314 |
| 4,213,592 | 7/1980 | Lingenfelser | 248/313 |

*Primary Examiner*—William H. Schultz

*Attorney, Agent, or Firm*—Holman & Stern

[57] ABSTRACT

A holder for a container, which comprises a backplate and a retaining strap. The backplate provides, on one face, an engagement surface, a ledge perpendicular to the face and spaced from the engagement surface, a guide sloping downwards and outwards from the face towards the ledge, and a step formed on or by the guide. The retaining strap is semi-rigid and is secured to the backplate to define a space between itself and the backplate. A projection with a curved outer face is formed on the restraining strap. In use, the base of a container rests on the ledge, an upper part of the container wall bears against the engagement surface, and an intermediate part of the container wall bears against the projection.

10 Claims, 6 Drawing Figures

HOLDER FOR A CONTAINER

BACKGROUND OF THE INVENTION

The present invention relates to a holder for a container. An object of the invention is the provision of a holder which will hold a container securely in a desired position in such a way that, although the container can be inserted and removed easily from the holder, the container cannot easily fall or bounce out of the holder.

As used herein, the term 'container' includes cans, bottles, or other receptacles, having a substantially circular or rectangular cross-section.

BRIEF SUMMARY OF THE INVENTION

The present invention provides a holder for a container, said holder comprising: a backplate one face of which provides an engagement surface, a ledge spaced from said engagement surface the the plane of said ledge being substantially perpendicular to that of said one face, a guide which slopes from said face downwards and outwards said ledge, and a step formed on or by said guide; and a semi-rigid retaining strap each end of which is secured to the backplate so as to define a space between part of one face of the retaining strap and said one face of the backplate, said part of one face of said retaining strap having thereon a projection with a curved outer face; said engagement surface, ledge, guide, retaining strap and projection being dimensioned and arranged such that when the holder is in use a container occupies said space with at least part of the base of the container resting on said ledge, an upper part of the container wall bearing against said engagement surface, and an intermediate part of the container wall bearing against said projection.

If the container to be placed in the holder has a substantially rectangular cross-section, then said part of one face of the strap is in the shape of at least two of the sides of the rectangle. If the container to be placed in the holder has a substantially circular cross-section, then said part of one face of the strap comprises a central curved portion with a substantially straight portion at each end thereof.

The engagement surface may be formed e.g. by said one face of the backplate or by a wall formed on, or at one end of, said one face. The step may be formed e.g. by an indentation or protrusion on the guide or simply by the end of the guide, where the guide ends above the ledge.

DETAILED DESCRIPTION OF A PREFERRED EMBODIMENT

Figure 1:
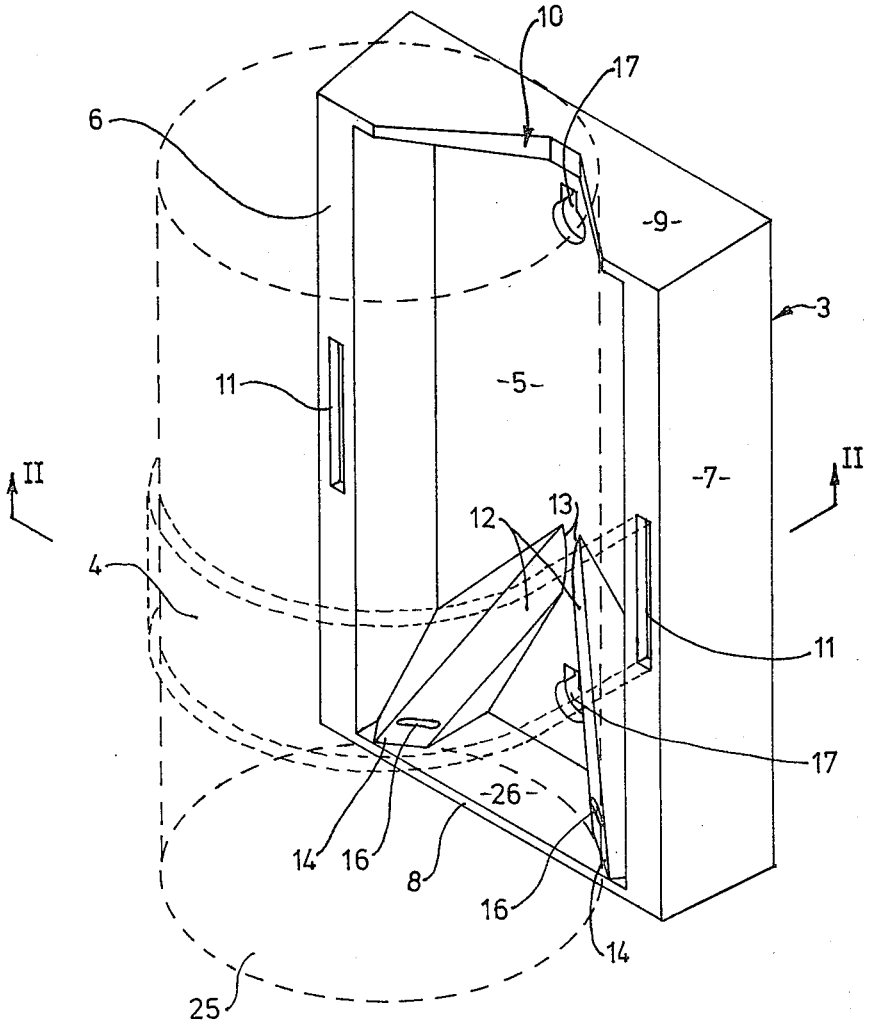
FIG. 1 is a perspective view of a holder in accordance with the present invention, with a container and the retaining strap part of the holder shown in broken lines.

Referring to the drawings, a holder comprises a backplate 3 and a retaining strap 4. The backplate 3 comprises a rectangular plate 5 which has a wall 6, 7, 8, 9, formed along each edge. The opposite side walls 6, 7, are the same depth as the lower wall 8, but the central portion of the upper wall 9 is cut away, as indicated by reference numeral 10. Slots 11 are cut in each side wall 6, 7, to allow the ends of the retaining strap 4 to pass through.

A guide including two diverging surfaces 12 is secured to the plate 5. Each guide surface 12 starts on the longitudinal center-line of said plate 5, just below the level of the slots 11, and slopes down to the junction of the lower wall 8 and the adjacent side wall 6 or 7. The guide increases in thickness gradually along its length, from a negligible thickness 13 to a thickness 14 equal to the height of the wall 8. Each guide surface 12 is formed with a step 16 which protrudes from said surface 12. Two spaced pegs or pins 18 are secured to the back of the plate 5.

The plate 5 has two spaced apertures 17 (preferably keyhole-shaped) through which nails or screws can be inserted to secure the holder to a supporting surface. Alternatively, the holder may be glued in position by applying glue to all or part of the back of the plate 5, or by gluing to the supporting surface two studs each shaped to co-operate with said aperture 17, and then hanging the holder on these studs.

Figure 2:
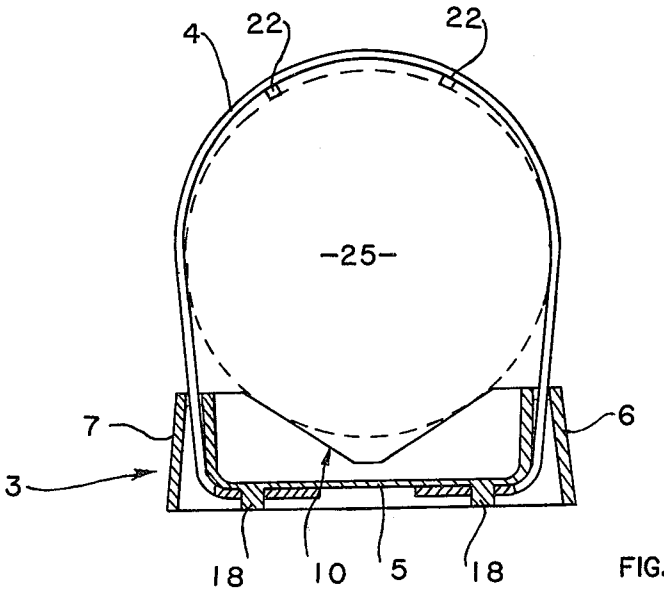
FIG. 2 is a cross-section on line II—II of FIG. 1, but showing the retaining strap in solid lines.
Figure 3:
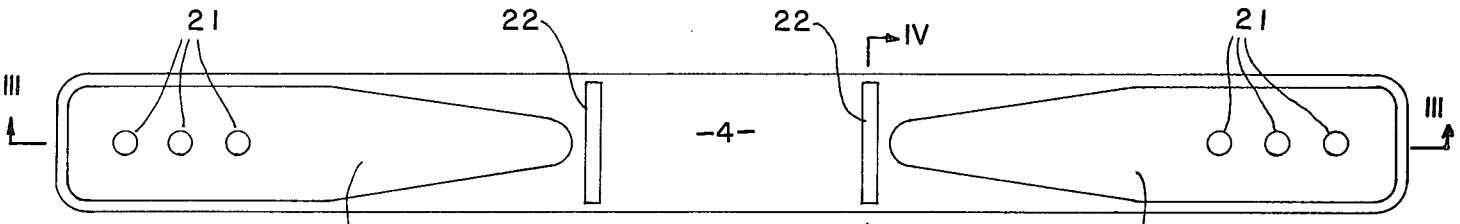
FIG. 3 is a plan view of the retaining strap laid flat.
Figure 4:
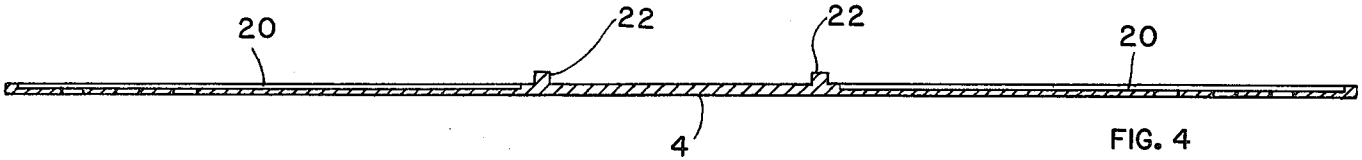
FIG. 4 is a cross section on line III—III of FIG. 3.
Figure 5:
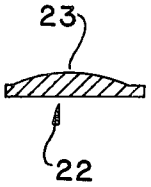
FIG. 5 is a section on line IV—IV of FIG. 3.

As shown in FIGS. 3–5, the retaining strap 4 comprises a strip of stiff semi-rigid material which is made relatively flexible in two regions 20 by reducing the thickness of the material in those regions. The reduction in thickness in the regions 20 is such that each said region is sufficiently flexible to be curved as shown in FIGS. 1 and 2 and to be bent around the back of plate 5 as shown in FIG. 2. Three holes 21 are formed in each end of the strap; each hole is dimensioned so as to be a push-fit over one of the pegs or pins 18. Alternatively, a strap 4' may be used taking the form of two sides of a rectangle (see FIG. 6) to accommodate an article of rectangular cross-section 25'.

A pair of projections 22 are formed on the strap 4, one on each side of the midpoint of the strap. Each projection 22 is formed with a rounded outer surface 23 as shown in FIG. 5.

The above-described holder is used as follows: the backplate 3 is secured to a vertical surface by glue or by nails or other fasteners inserted through the apertures 17; since these apertures are keyhole-shaped, the backplate can be lifted off the fasteners without damage and/or without removing the fasteners. The backplate 3 is oriented so that the wall 8 and guides 12 are below the wall 9.

The retaining strap 4 is then adjusted to length by removing one or both ends of the strap from the pegs or pins 18, sliding the strap through the slots 11 until the portion of the strap curving across the front of the plate 5 is the required length, and then pressing the ends of the strap over the pegs or pins 18 once more.

The container 25 (e.g. an aerosal can) to be secured by the holder is then lowered, base-first, into the space formed between the retaining strap 4 and the plate 5. The rounded outer surfaces 23 of the projections 22 prevent the strap 4 from snagging or binding on the container wall as it slides past the strap, so that a user can lodge or remove a container in or from the holder using only one hand.

When the base of the container reaches the guide surfaces 12, it slides down the said surfaces, and since these surfaces slope outwards (i.e. towards the strap 4) the container also is directed outwards into engagement with the strap 4. The base of the container is pushed over the steps 16 on the guide surfaces 12 and then further downward movement is stopped by part of the base coming into contact with the ledge 26 formed by a portion of the wall 8 between the guide surfaces 12. In this position, the container is in tight engagement with the surfaces 23 on the strap 4 and with the ledge 26. The container is also in tight engagement with an engagement surface formed by the edges of the cut-out edges of the cut-out 10 in the upper wall 9, because the outward slope of the guide surfaces 12 tends to press the upper wall of the container towards said wall 9.

The steps 16 tend to prevent the base of any container from being bounced upwards, out of the holder by jolting of the holder or its supporting surface. The steps 16 are especially effective with cans of the aerosol type which have a rolled lower edge which engages with the underside of the steps 16 when the can is in place in the holder.

The container is removed from the holder by pulling it over the steps 16 and then sliding it out of the space between the strap and the backplate.

It will be appreciated that the above-described holder may be made in any size. Preferably, both the retaining strap 4 and the backplate 3 are made of a tough, impact-resistant plastics material, and the backplate is moulded in a single piece. If desired, a plurality of holders may be joined or formed together to form a multi-holder unit. The retaining strap must be made of a material which is sufficiently stiff to maintain the correct shape, even when no container is in the holder. Both ends of the retaining strap may be adjustable (as described above) or only one end may be adjustable.

Figure 6:
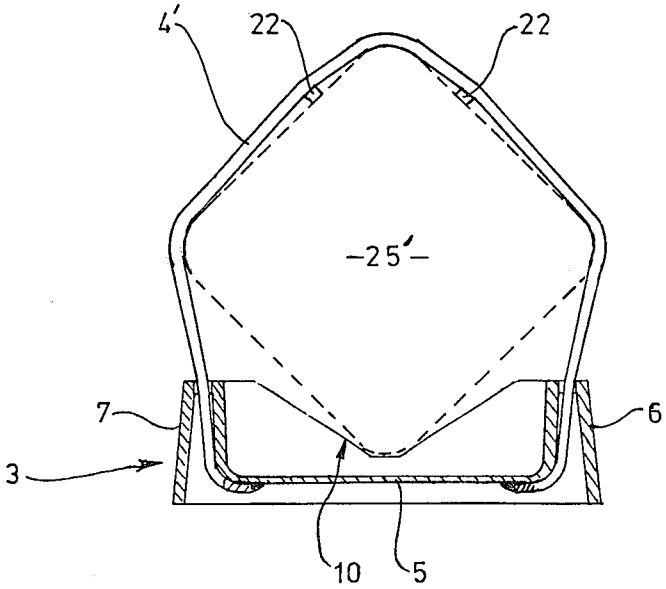
FIG. 6 is a cross-section similar to FIG. 2, but showing a different embodiment of the holder of the invention.

However, if holders are required only for containers of a fixed size, there is no need to make the retaining strap adjustable, and a strap of fixed length may be formed with its ends moulded or attached integrally with the backplate as shown in FIG. 6, for example.

The ledge 26 may project further outwards (e.g. level with the retaining strap) if the holder is to be used for very heavy containers and extra support is needed.

What I claim is:

1. A holder for a container, comprising, a backplate one face of which has an engagement surface thereon, a ledge spaced from said engagement surface, the plane of said ledge being substantially perpendicular to said one face, a guide which slopes from said one face downwards and outwards towards said ledge, a step on said guide, and a semi-rigid retaining strap each end of which is secured to the backplate so as to define a space between part of one face of the retaining strap and said one face of the backplate, said part of one face of said retaining strap having thereon at least one projection with a curved outer face, said engagement surface, ledge, guide, retaining strap and projection being dimensioned and arranged such that when the holder is in use, a container occupies said space with at least part of the base of the container resting on said ledge, an upper part of the container wall bearing against said engagement surface, and an intermediate part of the container wall bearing against said projection.

2. The holder as claimed in claim 1 wherein said part of one face of the retaining strap is substantially in the shape of two sides of a rectangle.

3. The holder as claimed in claim 1 wherein said part of one face of the restraining strap comprises a central curved portion with a substantially straight portion at each end of said curved portion.

4. The holder as claimed in claim 3 wherein each said straight portion is of reduced cross-sectional thickness relative to said curved portion.

5. The holder as claimed in claim 3 or claim 4 wherein there are two said projections in spaced relationship on said curved portion.

6. The holder as claimed in claim 1 wherein each end of said retaining strap is attached integrally with the backplate.

7. The holder as claimed in any one of claims 1–3 wherein at least one end of said retaining strap is removably secured to the backplate by an adjustable securing means provided on the retaining strap and backplate so that the length of said retaining strap is adjustable.

8. The holder as claimed in claim 7 wherein said securing means comprises at least one hole formed in the retaining strap and at least one protruding peg formed on the backplate, the hole being dimensioned so that the peg is a press-fit therein.

9. The holder as claimed in claim 1 wherein said guide comprises a pair of diverging surfaces each terminating at one end on the ledge.

10. The holder as claimed in claim 1 wherein the backplate is made in one piece.

* * * * *